US006935881B2

(12) United States Patent
Kainz et al.

(10) Patent No.: US 6,935,881 B2
(45) Date of Patent: Aug. 30, 2005

(54) ELECTRIC CONTACT COUPLING

(75) Inventors: Andreas Kainz, Leingarten (DE); Dominik Neuberger, Karlsruhe (DE); Uwe Ziegler, Sulzfeld (DE); Gregor Nowak, Sulzfeld (DE); Frank Moskob, Karlsruhe (DE); Robert Dost, Ölbronn (DE); Jürgen Veit, Bretten (DE); Bernd Schumann, Bretten (DE); Robert Austen, Gondelsheim (DE); Egbert Kurz, Mannheim (DE); Othmar von Berg, Bretten (DE); Monika Bauer, Bruchsal (DE); Klaus Hiller, Ötisheim (DE); Bernd Nussbaumer, Bretten (DE)

(73) Assignee: era-contact GmbH, Bretten (DE)

( * ) Notice: Subject to any disclaimer, the term of this patent is extended or adjusted under 35 U.S.C. 154(b) by 0 days.

(21) Appl. No.: 10/613,232

(22) Filed: Jul. 3, 2003

(65) Prior Publication Data

US 2004/0053528 A1 Mar. 18, 2004

(30) Foreign Application Priority Data

Jul. 5, 2002 (DE) ..... 102 30 379

(51) Int. Cl.[7] ..... H01R 13/62
(52) U.S. Cl. ..... 439/310; 439/135
(58) Field of Search ..... 439/310, 311, 439/135

(56) References Cited

U.S. PATENT DOCUMENTS 3,842,987 A 10/1974 Prada ..... 213/1.3
4,927,374 A * 5/1990 Batty ..... 439/310
5,529,510 A * 6/1996 Wakata et al. ..... 439/310
5,746,611 A * 5/1998 Brown et al. ..... 439/135

FOREIGN PATENT DOCUMENTS

| | | |
|---|---|---|
| CH | 236 846 A | 7/1945 |
| DE | 1 179 242 B | 10/1964 |
| DE | 1 187 704 B | 2/1965 |
| DE | 1 202 374 B | 10/1965 |
| DE | 14 38 777 A | 4/1969 |
| DE | 1 563 964 A | 1/1971 |

* cited by examiner

*Primary Examiner*—Javaid H. Nasri
(74) *Attorney, Agent, or Firm*—McCormick, Paulding & Huber LLP

(57) ABSTRACT

An electric contact coupling for connection of a first group of electric conductors to a second group of electric conductors, and especially for use in the coupling of rail and other vehicles with one another, comprises a first plug contact carrier and a second socket contact carrier which are movable into assembly with one another to bring the plug contact elements of the first contact carrier into electric contact with the socket contact elements of the second contact carrier. The two contact carriers are arranged in respectively associated contact carrier housings. The first contact carrier is movable by a positioning mechanism axially relative to its housing to bring its contacts into engagement with the contacts of the second carrier after the two carrier housings have been brought into engagement with one another. Transversely movable closure members seal the carrier housings against the penetration of dirt and moisture when the carrier housings are uncoupled from one another. The support for the two contact carriers in a coupled condition of the coupling is such that reasonable movement of one carrier housing relative to the other is accommodated without substantial loading of the contact elements to avoid damage to the elements. The contacts automatically clean themselves during the coupling procedure.

37 Claims, 4 Drawing Sheets

ELECTRIC CONTACT COUPLING

CROSS-REFERENCE TO RELATED APPLICATIONS

This application is entitled to the benefit of and incorporates by reference essential subject matter disclosed in German Patent Application No. 102 30 379.7 filed on Jul. 5, 2002.

FIELD OF THE INVENTION

The invention concerns an electric contact coupling comprising a first and a second contact carrier housing each of which receives respectively a first and a second contact carrier for first and second contact elements, which upon coupling come into electric contact with one another.

BACKGROUND OF THE INVENTION

Electric contact couplings of the above-mentioned kind are known wherein the contact elements are formed as pin and socket contacts. These guarantee a high transmission assurance, but are mechanically sensitive. They require an exact centering and parallel coupling planes. With tilted insertion or imprecise centering the coupling can lead to tilted and knicked contact pins. Further such electric contact couplings are known to have pressure loaded contacts in which one contact element is stationary while the other is spring loaded in the coupling direction. These contact elements are mechanically insensitive and have high requirements both as to the centering and the parallelism of the coupling planes. Their transmission quality is indeed moderate. The contact surfaces are relatively small and their contamination produces high resistance and signal attenuation.

The usual electrical contact couplings, which for example are used in combination with mechanical couplings for rail vehicles, have heavy rectangular housings with a protective flap, which flap is either self opening or forcibly controlled and which protects the contact elements in the uncoupled condition against contamination. The housings are shiftable on rods or rails to move the built in contact elements in the coupling plane. The movement of the housings takes place either by way of an individual drive, for example a pneumatic cylinder, or by way of a drive coupled with the mechanical coupling and which externally engages the housings. The housings are customarily suspended or supported with a certain amount of play with the positioning of the housings relative to one another in a coupling procedure being achieved by way of centering pins and bushings on the housings. The positioning in the axial direction is achieved by the pressing force of the mechanical coupling and through springs or rubber elements.

SUMMARY OF THE INVENTION

The invention has as its object the provision of a compact, modular and simply constructed electric contact coupling of the previously mentioned kind which provides a transmission of data, signals, or energy with high reliability and high freedom from disturbance.

This object is solved in accordance with the invention in that the first and the second contact carriers with respect to the coupling axis of the electric contact coupling are formed rotationally symmetrical, that the first contact carrier is formed as a plug part with a cylindrical outer circumferential surface on which the first sliding contact elements are arranged, and that the second contact carrier is formed as a socket part designed for reception of the plug part and having a cylindrical inner circumferential surface on which the second sliding contact elements are arranged.

Preferably one of the first and second sliding contact elements have stationary contact surfaces, while the other sliding contact elements have contact springs designed for engagement with the stationary contact surfaces.

In the solution of the invention the contact elements are essentially subjected to no mechanical loads. The sliding contact elements are first of all basically relatively insensitive to the expected mechanical forces, and moreover first come into contact with one another when the contact carriers have already been centered relative to one another. With each coupling procedure the sliding contact elements slide on one another whereby a cleaning of the contact surfaces takes place so that constantly a trouble free making of contact and thereby trouble free signal transmission is possible. The contact carriers because of their rotationally symmetrical shape are easy to manufacture, and the centering of a cylindrical plug part in a cylindrical socket part in easy and reliable ways can be assured for example by conical centering surfaces on the contact carriers.

The electric contact coupling of the invention can be actuated manually as well as automatically. It can be used in various technical fields where conductors for energy, data and signal transmission are to be releasably connected with one another. It is especially intended for use with mechanical couplings for vehicles, especially rail vehicles.

Preferably one of the contact carriers is axially adjustable by means of a positioning device. In one preferred embodiment this is the first contact carrier, which for example is connected with a double acting pneumatic cylinder. The other contact carrier is advantageously axially elastically supported and biased in the coupling direction so that upon the contact carriers coming together it can axially deflect to compensate for manufacturing tolerances of the contact carrier housings and to take up play appearing during operation.

In the case of the rotationally symmetric formation of the contact carriers, to assure a coming together of the associated contact elements, it is advantageous if the contact carriers are rotationally securely supported in their associated contact carrier housings. This rotational securing can for example be achieved through the use of pin/groove guides on the parts which are movable relative to one another.

Since the sliding contact elements of the first contact carrier are arranged on its outer circumferential surface, this offers the possibility of arranging further contact elements inside of the first contact carrier. For this, the first contact carrier can have a pot shaped cylindrical recess on its side facing the second contact carrier, in which recess plug contact elements are arranged which are intended for cooperation with complementary contact elements on the second contact carrier. For example, the plug contact elements are formed by contact pins and complementary contact elements are formed by plug sockets. Since the centering force applied to the plug part and to the socket part is taken up by their centering surfaces, the plug contact elements in a solution of the invention are substantially free of mechanical loads such as appear in the case of customary electric contact couplings with pin/socket contacts. However, for complete assurance and at the same time to avoid transverse forces on the contact pins, the recess of the first contact element can further have centering elements arranged in it. These centering elements can, for example, be formed as ribs made of an electric conducting material, which ribs extend between the plug contact elements and which upon coupling are received in complementary recesses in the second contact carrier. The centering elements thereby take on the further function of acting as screen elements, by means of which an electric screen can be further achieved, and which elements surround the plug contacts either individually or in groups.

The first contact carrier can on its side facing away from the second contact carrier be connected with a contact carrier container which receives the terminal ends of the contact elements, the bottom of which container is connected with the piston rod of the pneumatic positioning device which has an axially through going cable channel communicating with the contact carrier container. Thereby, the cable to the first contact carrier can be guided to the first contact carrier through the hollow piston rod. If the contact carrier is connected directly with the container bottom and releasably with the contact carrier container, the jacket of the contact carrier container can be loosened from the container bottom and can be withdrawn forwardly from the contact carrier so that the terminal ends of the contact elements of the first contact carrier are exposed. This simplifies assembly and servicing.

To inhibit the penetration of moisture and dirt into the coupled together contact carriers it is advantageous if sealing surfaces are formed on the first contact carrier intended for engagement with the second contact carrier housing.

As has already been said, the second contact carrier is advantageously axially movable and supported in the second contact carrier housing with radial play and has on its outer edge facing the first contact carrier a conical centering surface for engagement with a complementary conical abutment surface of the second contact carrier housing, with the second contact carrier being biased by spring means in the direction toward the abutment surface. When the second contact carrier, in the case of an opened coupling, is pressed by the axially operating spring against the abutment surface of the second contact carrier housing it is automatically centered. On the other hand, if in the coupled condition it is axially lifted from this abutment surface it obtains at the same time a radial play so that both axial and radial movements of the contact carrier housings relative to one another which appear during operation can be compensated, without the contact carriers moving relative to one another.

Advantageously, the contact carrier housings are provided with mechanical centering means which in the coupling procedure come into mating engagement with one another so that the contact carrier housing are oriented relative to one another before the first contact carrier is moved and the contact elements meet with one another. The centering means can have an associated signal producer which responds to the mating engagement of the centering means and which, for example, commands the positioning of the first contact carrier as soon as the two contact carrier housings have been oriented relative to one another. The signal producer can, however, also be arranged on the mechanical coupling and be responsive to the closing of the mechanical coupling.

To compensate for the mechanical tolerances of the coupling heads, it is advantageous if at least one of the contact carrier housings is fastened to its associated coupling head by means of elastic fastening elements. These fastening elements can be so arranged that the contact carrier housing extends in the coupling direction slightly beyond the associated coupling head of the mechanical coupling. This assures that independently of the play of the mechanical coupling the contact carrier housings of the electric contact coupling can in all cases come into engagement with one another.

To assure a reliable making of contact even during operation, the first contact carrier in the coupled condition is latchable either directly with the second contact carrier or with the second contact carrier housing. For this, on one of the parts to be latched together at least one radially adjustable latching element is arranged which is designed to matingly engage with a corresponding recess in the other part. For example, the latching element is a pin moveable by an electromagnet. The latching element can be arranged on the socket part or on the second contact carrier housing. To avoid an overloading of the electric contact coupling in the case of an unintended loosening of the mechanical coupling the latching element is advantageously so designed that in the case of a pulling force on a coupled together parts which exceeds a predetermined threshold value the latching is released. This can be achieved by an appropriate shaping of the latching element with a ramp surface and the like, and in unfavorable situations by the integration of a safety facture point in the latching element.

Advantageously, a sensor is provided which supervises and controls the entire insertion of the plug part into the socket part. The sensor, for example made as a proximity sensor, upon entire insertion of the plug part into the socket part switches off the positioning device and controls the actuation of the latching element. Upon an undesired movement of the coupling parts from one another the sensor, as the case may be, produces a further switching on of the positioning device.

The positioning device can be so designed that in the coupled condition it is switchable into a free running position in which the first contact carrier is freely axially movable relative to the first contact carrier housing. When the first contact carrier in a coupled condition is latched to the second contact carrier housing and the second contact carrier is biased against the first contact carrier a relative movement between the contact carrier housings cannot be transmitted to the contact carriers. That is, these remain uninfluenced by the relative movement and can move in common relative to the first contact carrier housing. This avoids that the contact elements on the contact carriers rub against one another as a result of a relative movement of the contact carrier housings.

To protect the contact elements of the electric contact coupling in the uncoupled condition against dirt and the penetration of moisture, the coupling openings of the respective contact carrier housings are closable by a controllable closure, as is in itself already known. In the solution of the invention this closure preferably includes at least one closure plate movable perpendicularly to the coupling axis. In contrast to the known pivotal flaps this solution has the great advantage that the closure is first brought into opened condition when the contact carrier housings of the electric contact coupling are already in engagement with one another and the coupling openings of the contact carrier housing are thereby already protected against the penetration of dirt and moisture. A flap on the other hand must first be pivoted away before the contact carrier housings can be moved into engagement with one another, so that the coupling openings lie freely unprotected at least until the coming together of the contact carrier housings. With the solution of the invention the closure is also advantageously controllable in dependence on the coupling procedure. That is, the closure is first opened when the two contact carrier housings engage one another and the closure is closed before the two contact carrier housings are separated from one another. Instead of a slidable closure plate a kind of jalousie can also be provided. This also can be so implemented that the coupling openings are first brought into open condition after the coming together of the contact carrier housings.

BRIEF DESCRIPTION OF THE DRAWINGS

Further features and advantages of the invention will be apparent from the following description, which in combination with the accompanying drawings explains the invention by way of an exemplary embodiment. The drawings are.

DETAILED DESCRIPTION OF THE PREFERRED EMBODIMENTS

Figure 1:
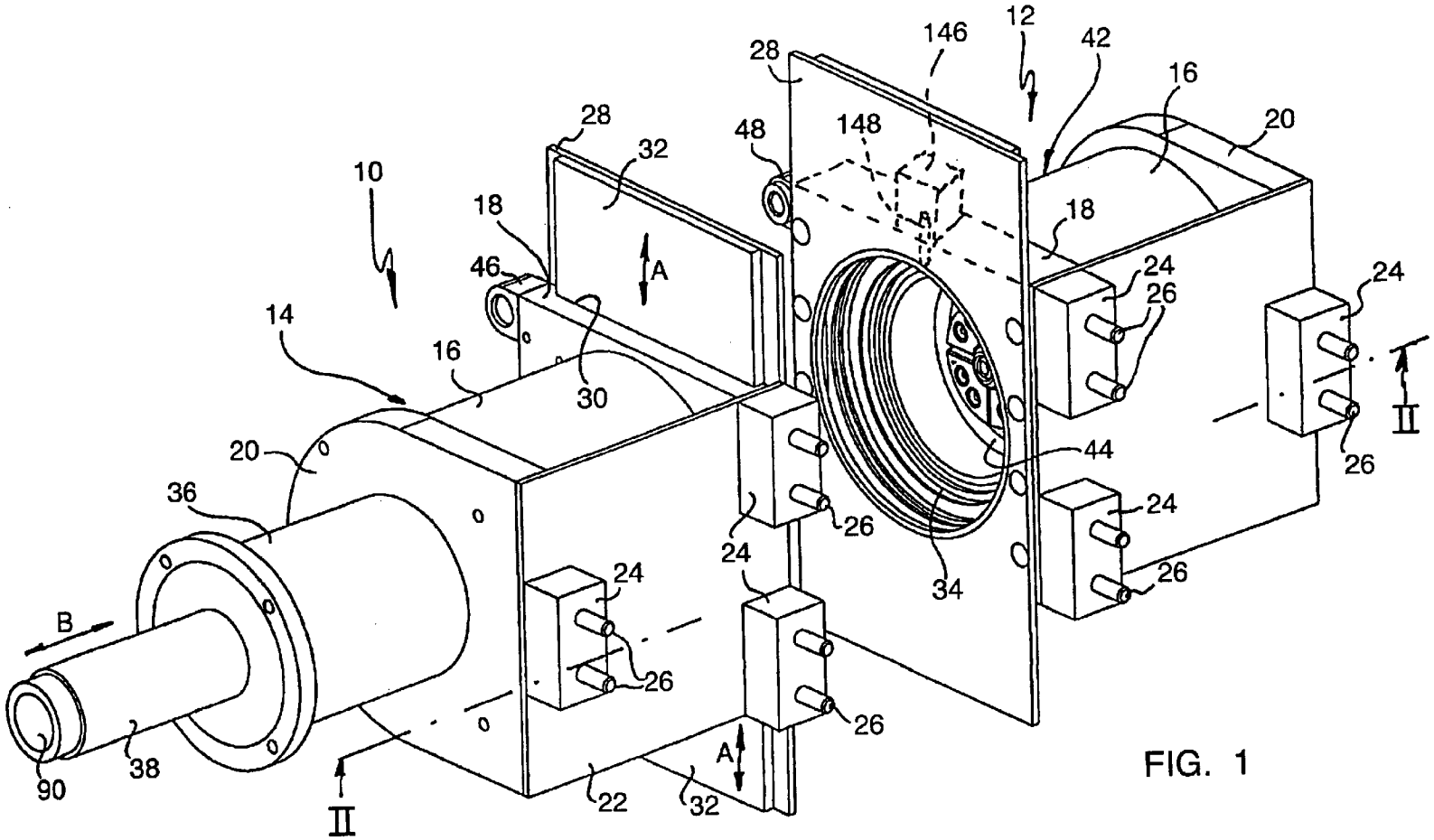
FIG. 1 A partially schematic three-dimensional total view of an electric contact coupling embodying the invention, FIG. 2 An axis containing sectional view through the electric contact coupling taken along the line II—II of FIG. 1, FIG. 3 A three-dimensional illustration of the first contact carrier formed as a plug part, FIG. 4 A three-dimensional illustration corresponding to that of FIG. 3 and of the second contact carrier formed as a socket part, FIG. 5 A schematic side view of one of the first sliding contact elements, and FIG. 6 A schematic side view of one of the second sliding contact elements.

The electric contact coupling illustrated schematically in FIG. 1 includes a first coupling part indicated generally at 10 and a second coupling part indicated generally at 12. The first coupling part has a first coupling housing 14 with a cylindrical wall 16 which is limited axially by a forward flange 18 and by a rear flange 20. These flanges 18 and 20 are flattened on one side and connected with a mounting plate 22. The mounting plate carries rubber buffers 24, in which threaded bolts 26 are embedded by means of which the coupling part 10 can be fastened to the non-illustrated coupling head of a mechanical coupling for rail vehicles. The forward flange 18 is covered by an abutment plate 28 oriented perpendicularly to the axis of the cylindrical contact carrier housing 14, which abutment plate 28 laterally (in FIG. 1 upwardly and downwardly) extends beyond the forward flange 18. In a recess 30 in the forward flange 18 and located rearwardly of the abutment plate 28 are two plate shaped slides 32 which are movable back and forth of the direction of the arrow A, which slides can close or open a circular coupling opening 34 in the forward flange 18 and in the abutment plate 28. The positioning drive for the slides 32 is not illustrated and can in principle be of discretionary choice. Attached to the rear flange 20 and extending rearwardly therefrom is a pneumatic cylinder 36 out of which a piston rod 38 extends which is connected with a first contact carrier, indicated generally at 40, arranged in the contact carrier housing, so that the first contact carrier can be moved in the axial direction as is explained in more detail hereinafter.

The second coupling part includes a second contact carrier housing 42, which essentially is built exactly the same as the first contact carrier housing 14, so that similar parts are provided with the same reference numbers and are not explained again. The second contact carrier housing 42 serves to receive a second contact carrier 44 which is explained in more detail hereinafter.

Figure 2:
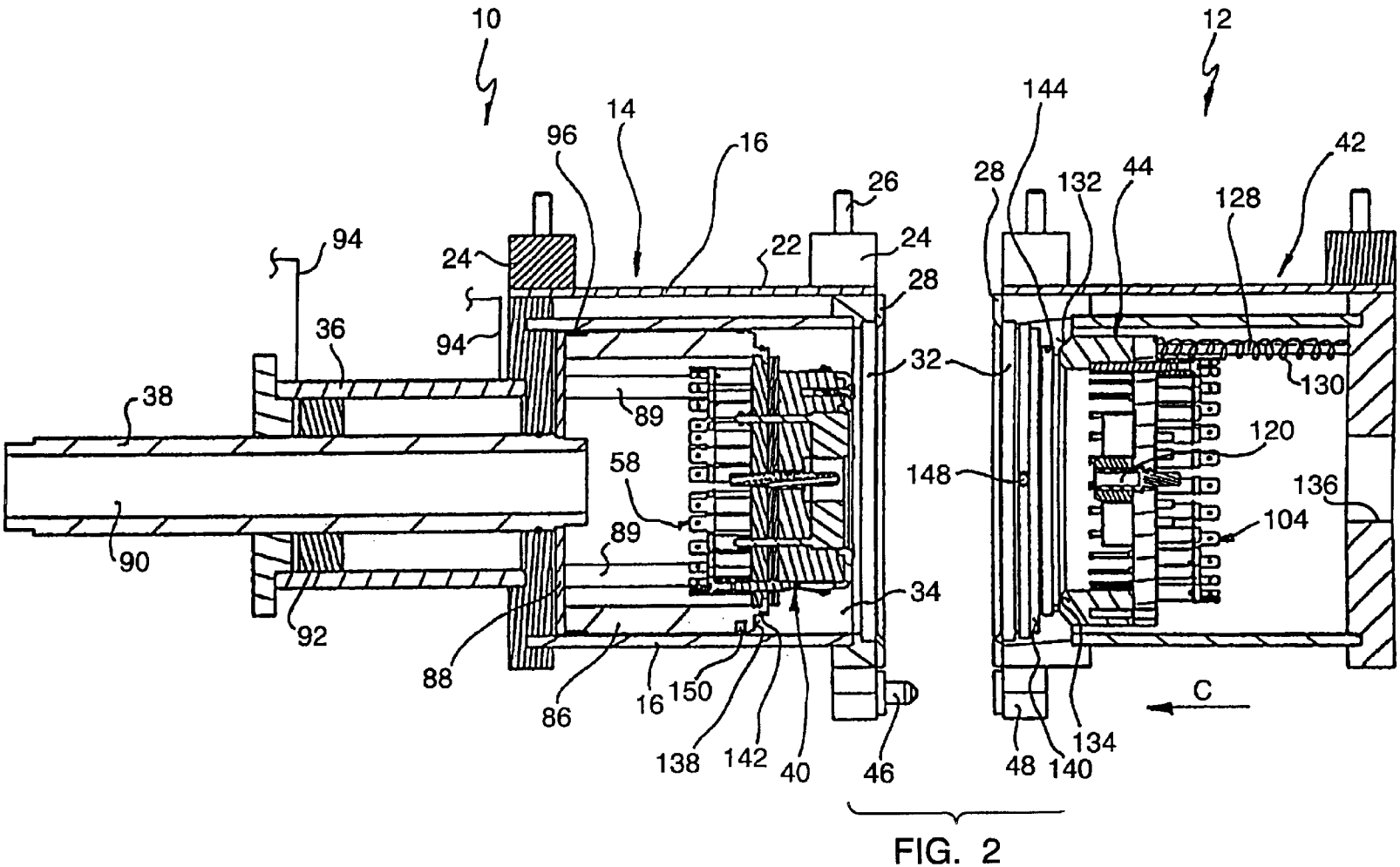

At the forward flanges 18 of the two contact carrier housings 14, 42 are arranged centering pins 46 and centering sockets 48, of which in FIGS. 1 and 2 only a pair is illustrated, and which upon a coupling process move into mating engagement with one another to orient the two coupling parts 10 and 12 co-axially to one another before the contact carriers 40 and 44 move into engagement with one another.

Figure 3:
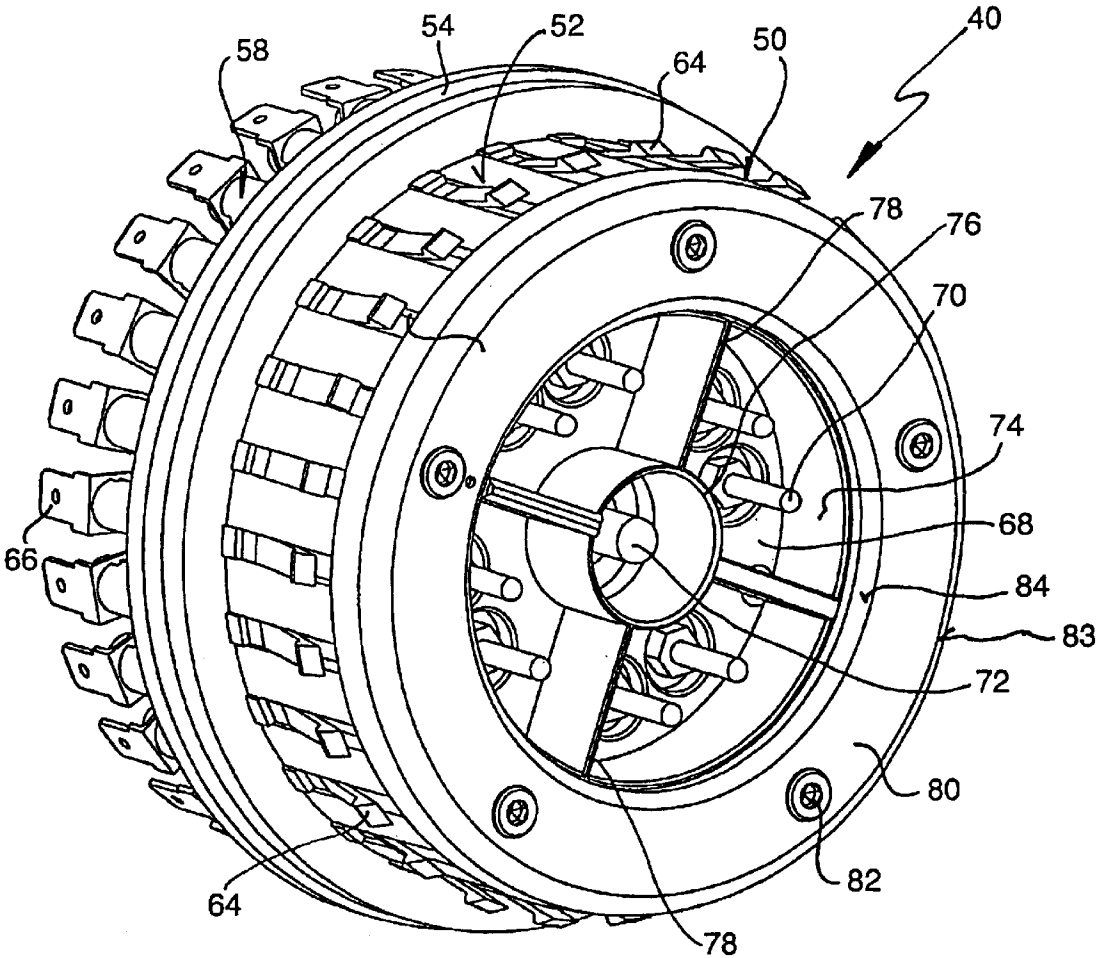
Figure 5:
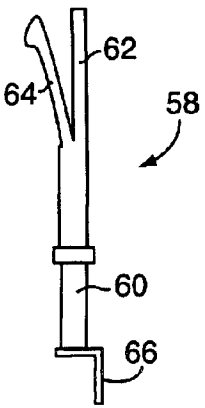

According to FIG. 3 the first contact carrier 40 has a rotationally symmetrically formed insulating body 50 with a cylindrical outer circumferential surface 52. At its rear end the insulating body 50 has a circular flange 54 extending radially beyond the circumferential surface 52. Axis parallel grooves 56 depressed inwardly from the circumferential surface are formed in the circumferential surface 52 and into each of these grooves is inserted a first contact element 58. Each first contact element 58 according to FIG. 5 has a cylindrical shaft part 60 and an elongated support part 62 which is received in the groove 56 and on which a contact spring 64 is arranged. A terminal lug 66 is fixed to the rear free end of the shaft part 60. The contact element 58 can be made as a one-piece part.

At its forward, in FIG. 3 the viewer facing, end the insulating body 50 has a cylindrical pot shaped recess 68 in which further contact elements in the form of plug contact pins 70 are circularly arranged. In the middle of this recess is a contact pin 72. The contact pins 70 and 72 are each surrounded by a cylindrical screen surface 74 or 76, the screen surfaces 74 and 76 being connected with one another by radial ribs 78, which like the screen surfaces 74 and 76 are made of metal and along with their screening effect also serve as centering elements as will be explained later in more detail. The contact elements 70, 72 and the screens 74, 76, 78 can be part of an insert which is insertable into the pot shaped recess 68 and is held in place by an end ring 80 which by the help of screws 82 is fastened to the insulating body 50. The end ring 80 is provided with conical centering surfaces 83, 84 which facilitate the insertion of the first contact carrier 40 formed as a plug part into the second contact carrier 44 formed as a socket part.

At its rear end the contact carrier 40 is connected with a cylindrical contact carrier container 86 which is closed by a container bottom 88 and which receives the shaft parts of the contact elements 58 with the terminal lugs 66. The contact carrier is in this case directly connected with the container bottom 88 by bolts 89. The bolts pass through the insulator body 50 in non-illustrated ways up to the end surface of the insulating body lying under the end ring 80, so that the connection between the first contact carrier 40 and the container bottom can be undone from the front. The jacket of the contact carrier container is likewise connected with the bottom by non-illustrated screws accessible from the front and can therefore be pulled off toward the front. This facilitates access to the terminal lugs of the contact elements 58.

The piston rod 38 is rigidly connected with the container bottom 88. The piston rod 38 is formed as a tube with a central channel 90 through which a non-illustrated cable is guided, which cable is made up of cable conductors for connection with the terminal lugs 66. The piston rod is further rigidly connected with a piston 92 which is slidably supported in the cylinder 36. The cylinder 36 is formed as a double-acting cylinder which is connectable with schematically indicated pneumatic conductors 94 to shift the piston 92 and therewith the contact carrier 40 back and forth in the direction of the double arrow B. The outer end of the piston rod 38 can be protected by a non-illustrated bellows. As will be understood, the moveable parts of the adjusting device lie inside of the contact carrier housing 14 and of the cylinder 36 rigidly connected with the housing and are therefore protected from external influences. The result is thereby a very compact and robust coupling construction.

The contact carrier container 86 has at its outer circumferential surface a slide ring 96 by means of which it is slidably guided on the inner surface of the housing wall 16.

Figure 4:
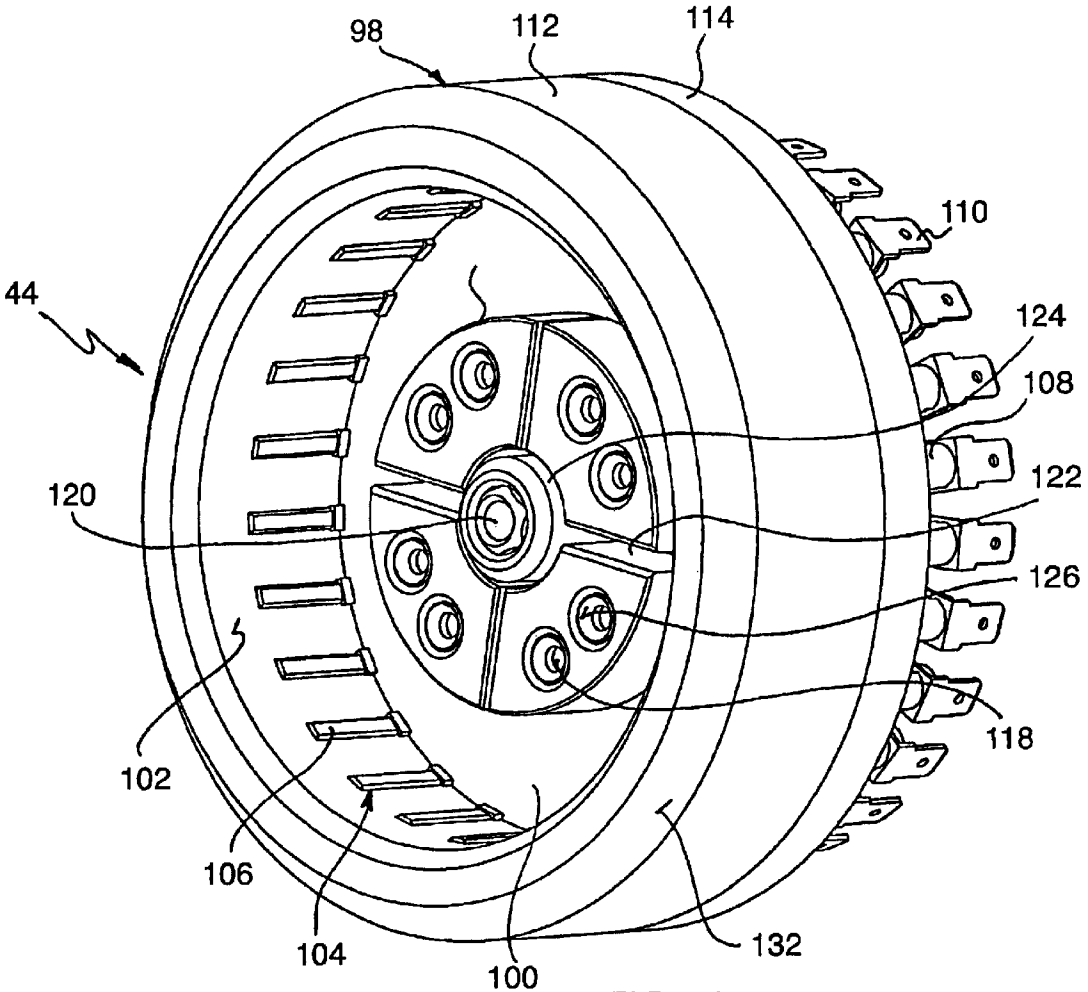
Figure 6:
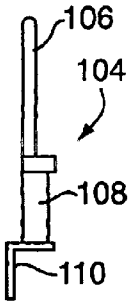

The second contact carrier 44 illustrated in FIG. 4 is formed as a socket part with an insulating body 98 having a pot shaped recess 100. On the cylindrical inner circumferential wall 102 of the recess 100 are arranged second contact elements 104 with uniform circumferential spacing, which contact elements 104 have stationary contact pads 106. The contact elements 104 are illustrated in FIG. 6. The stationary contact pads 106 are connected with a cylindrical shaft part 108 on the free end of each of which is a terminal lug 110. The contact elements 104 are received in non-illustrated recesses in the insulator body 98.

The insulator body 98 comprises a ring 112 closed at its rearward side by a bottom 114. On its side facing the ring 112 the bottom 114 carries a cylindrical pedestal 116 in which are arranged plug sockets 118, 120 complementary to the contact pins 70 and 72 of the first contact carrier 40. The pedestal 116 is divided by radially running slots 122 and a cylindrical circular slot 124. The slots 122 and 124 serve to receive the ribs 78 and the screen 76 when the first contact carrier 40 is inserted into the second contact carrier 44. The contact sockets 118 have funnel shaped widened guide surfaces 126 which facilitate the insertion of the contact pins into the contact sockets 118.

The contact carrier 44 is slidably supported with radial play on axis parallel studs 128 in the contact carrier housing 42 and is biased in the direction of the arrow C by springs 130. The studs 128 have in the insulating body 28 of the second contact carrier 44 a radial play, so that the second contact carrier 44 can accommodate radial tolerances.

The ring 112 of the insulation body 98 has at its free end a conical surface 132 designed for engagement with a complementary conical surface 134 of the contact carrier housing 42, as its illustrated in FIG. 2. By way of these conical surfaces 132 and 134 the second contact carrier 44 is automatically centered when it is pressed by the springs 130 against the engagement surface 134.

The rear flange 20 of the second contact carrier housing 42 has an opening 136 through which a cable having conductors for connection with the contact elements 104, 118 and 120 can be guided into the interior of the housing.

The coupling parts 10 and 12 are so fastened onto the non-illustrated coupling heads of the mechanical coupling that they protrude slightly in the coupling direction beyond the associated coupling heads. When the coupling heads are moved together in the coupling direction it is thereby assured that the abutment plates of the coupling parts 10 and 12 come into engagement with one another with the centering elements 46 and 48 on the housing flanges 18 coming into mating relation with one another so that the contact carrier housings 14 and 42 are co-axially oriented relative to one another. A non-illustrated sensor can be provided which reports when the abutment plates are engaged with one another and the centering means 46, 48 mated with one another. In response to the sensor signal the closure slides 32 on the two contact carrier housings 14 and 42 are opened. Subsequently with the help of the pneumatic cylinder 36, the first contact carrier 40 is pushed toward the right in FIG. 2 out of the first contact carrier housing and into the second contact carrier 44. The two contact carriers become centered relative to one another by the mentioned various centering surfaces so that the contact pins 70 and 72 become inserted into their respectively associated contact sockets 118 and 120 without their existing any danger of a canting of the pins. At the same time the contact springs 64 of the first contact elements 58 slide on the contact pads 106 of the second contact elements 104 so that the contact surfaces become cleaned. When the first contact carrier 40 has reached its end position in the second contact carrier 44 this event can be reported by the aid of a further non-illustrated sensor, for example a limit switch. In this position an annular surface 138 formed on the contact container 86 lies on a complementary annular surface 140 of the second contact carrier housing 42. At the same time an annular seal 142, for example an O-ring arranged on the contact carrier container 86, by its engagement with a cylindrical annular surface 44 of the second contact carrier housing 42 seals access to the interior of the housings.

In this position the first contact carrier 42 is locked to the second contact carrier housing 42. For this at least one electromagnet 146, indicated by broken lines in FIG. 1, is arranged on the forward flange 18 of the second contact carrier housing 42, which electromagnet radially moves a locking pin 148 so that it can become inserted into a recess 150 formed in the wall of the contact carrier container 86. In FIG. 2 this recess 150 is illustrated as displaced by 90°. In place of an electromagnet 146 with a pin 148, or of a similar mechanical signal actuated lock, an elastic mechanical locking arrangement opened upon the exceeding of a threshold value can be provided, which arrangement, for example, can be formed by a ball notch with a spring loaded ball or an iris spring.

To avoid, in this case of an unwanted opening of the mechanical coupling the electric contact coupling being damaged, the above described locking mechanism can be so designed that upon the exceeding of a pregiven pulling force which pulls the two coupling parts 10 and 12 from one another, the locking mechanism yields. With an elastic mechanical locking the threshold value can be determined by a suitable selection of the spring element. Likewise a mechanical locking can be so designed that it opens automatically with a pregiven pulling force. For this a ramp surface is provided on the latching pin by means of which the pin is urged to its freeing position when the axial pulling force exceeds a pregiven value. Additionally to this in the case of the described locking with a radially adjustable pin this pin can be a shear pin provided with a predetermined breaking point.

The previously described electric contact coupling is comprised of parts which are simple to make and assemble. The contact carrier housings, which entirely enclose the contact elements can reliable insure against the intrusion of dirt and moisture, since they are only open when the abutment plates 28 of the two coupling parts 10 and 12 lie against one another and therefore practically no dirt or moisture can penetrate into the inner space of the contact carrier housings. By means of the sliding contacts a reliable making of contact is assured. Since the contact carriers themselves mate with one another the contact elements are not stressed in the making of their contacts. They can automatically clean themselves. The large surfaced centering of the mating contact carriers assures that the contact pins in the first contact carrier can enter into the associated contact sockets of the second contact carrier without radial strain. The axial deflectability of the second contact carrier and its radial play permit a compensation of axial and radial relative movement of the contact carrier housings. To a certain extent spring fastening of the coupling parts 10 and 12 to the associated coupling heads of the mechanical coupling permits a compensation of the movement of the mechanical coupling. A displacability of the contact carrier housings on the coupling heads of the mechanical coupling is not necessary. The presently described electric contact coupling is not only easy to assemble but is also easy to maintain.

What is claimed is:

1. An electric contact coupling comprising: a first and a second contact carrier housing; each of the first and second contact carrier housings containing at least one contact carrier, each of the contact carriers containing at least one of a first contact element and a second contact element, the contact elements electrically coupleable with one another along a coupling axis; the contact carriers being approximately rotationally syninietrical about the coupling axis; the first contact carrier defining a plug portion and an outer surface on which the first contact element is slidably positioned; and the second contact carrier defining a socket portion adapted to mate with the plug portion and an inner surface on which the second contact elements is slidably positioned.

2. An electric contact coupling according to claim 1, wherein the coupling is manually actuatable.

3. An electric contact coupling according to claim 1, wherein the coupling is automatically actuatable.

4. An electric contact coupling according to claim 3, wherein each contact carrier housing includes means for automatic mechanical coupling to vehicles.

5. An electric contact coupling according to claim 1, wherein one of the first and second contact elements have stationary contact surfaces and that the other sliding contact elements each have a spring contact for engagement with the stationary contact surfaces.

6. An electric contact coupling according to claim 1, wherein one of the contact carriers is axially adjustable by means of a positioning device.

7. An electric contact coupling according to claim 6, wherein the first contact carrier is axially adjustable by means of a positioning device and wherein the positioning device comprises a piston rod of a double acting pneumatic cylinder.

8. An electric contact coupling according to claim 6, wherein the other contact carrier is elastically axially supported and is biased in the coupling direction.

9. An electric contact coupling according to claim 1, wherein the contact carriers are rotationally supported in their associated contact carrier housings.

10. An electric contact coupling according to claim 1, wherein the first contact carrier includes a cylindrical recess having plug contact elements arranged therein and matable with socket contact elements defined by the second contact carrier.

11. An electric contact coupling according to claim 10, wherein the plug contact elements are formed as contact pins and the socket contact elements are formed as sockets.

12. An electric contact coupling according to claim 1, wherein centering surfaces are formed on the plug portion and on the socket portion for cooperation with one another.

13. An electric contact coupling according to claim 10, wherein centering elements are arranged in the recess defined by the first contact carrier.

14. An electric contact coupling according to claim 13, wherein the centering elements are formed as ribs of an electric conducting material, which ribs extend between the plug contact elements and upon coupling are received in complementary recesses in the second contact carrier.

15. An electric contact coupling according to claim 13, wherein the centering elements surround the plug contact elements, the centering elements acting individually or in groups as an electric screen.

16. An electric contact coupling according to claim 1, wherein the first contact carrier is connected with a contact carrier container which receives terminal ends defined by the first contact element, the bottom of the contact carrier container being connected with the piston rod of the pneumatic positioning device, the piston rod having an axially though going cable channel in communication with the contact carrier container.

17. An electric contact coupling according to claim 16, wherein a sealing surface is formed on at least one of the first contact carrier and the contact carrier container for engagement with the second contact carrier housing.

18. An electric contact coupling according to claim 1, wherein the second contact carrier being axially movably and supported in the second contact carrier housing, the second contact carrier on its outer edge facing the first contact carrier having a conical centering surface for engaging a complementary conical abutment surface of the second contact carrier housing, wherein the second contact carrier being biased by spring means in the direction toward the abutment surface.

19. An electric contact coupling according to claim 1, wherein the first and second contact carrier housings each include mechanical centering means and wherein the mechanical centering means included in the first contact carrier housing are matable with the mechanical centering means included in the second contact carrier housing.

20. An electric contact coupling according to claim 19, wherein the mechanical centering means of the first and second carrier housings has an associated signal producer which responds to the mating engagement of the mechanical centering means.

21. An electric contact coupling according to claim 1, wherein at least one of the first and second contact carrier housings is coupleable to a coupling head via an elastic fastening element.

22. An electric contact coupling according to claim 21, wherein the elastic fastening elements are arranged so that the contact carrier housings extend in their coupling directions slightly beyond the associated coupling head.

23. An electric contact coupling according to claim 1, wherein the contact carrier housings each further comprise controllable closure means for moving the coupling openings defined by the contact carrier housings between an open and a closed position.

24. An electric contact coupling according to claim 23, wherein the contact carrier housings further comprise at least one closure plate movable substantially perpendicularly relative to the coupling axis.

25. An electric contact coupling according to claim 23, wherein the closure is independently controllable.

26. An electric contact coupling according to claim 1, wherein the contact carriers in the coupled position are lockable relative to one another.

27. An electric contact coupling according to claim 1, wherein the first contact carrier is lockable with the second contact carrier housing.

28. An electric contact coupling according to claim 26, further comprising a radially movable locking element on one of the first and second contact carriers, the locking element being insertable into an associated recess defined by the other of the first and second contact carrier.

29. An electric contact coupling according to claim 28, wherein the locking element on one of the first and second contact carriers is a pin movable by an electromagnet.

30. An electric contact coupling according to claim 26, wherein the first and second contact carriers are lockable to one another by means of at least one detent element.

31. An electric contact coupling according to claim 28, wherein the detent element is arranged on the second contact carrier housing.

32. An electric contact coupling according to claim 28, wherein detent element is arranged on the socket portion.

33. An electric contact coupling according to claim 28, wherein the detent element is so formed that in the event a pulling force exceeds a given threshold value the first and second contact carriers become unlocked from one another.

34. An electric contact coupling according to claim 1, wherein at least one of the first and second contact carrier housings further comprises a sensor that controls the insertion of the plug portion into the socket portion.

35. An electric contact coupling according to claim 6, wherein the positioning device comprises movable parts arranged at least substantially in one of the first contact carrier housing and a housing connected with the first contact carrier housing.

36. An electric contact coupling according to claim 8, wherein the positioning device in a coupled condition is switchable to a free running position in which the first contact carrier is axially freely movable with respect to the first contact carrier housing.

37. The electric contact coupling according to claim 4, wherein the vehicle is a rail vehicle.

* * * * *

UNITED STATES PATENT AND TRADEMARK OFFICE

CERTIFICATE OF CORRECTION

PATENT NO. : 6,935,881 B2
DATED : August 30, 2005
INVENTOR(S) : Andreas Kainz et al.

It is certified that error appears in the above-identified patent and that said Letters Patent is hereby corrected as shown below:

Column 9,
Line 18, the word “syninietrical” should be replaced with -- symmetrical --.

Column 10,
Line 13, the word “though” should be replaced with -- through --.

Signed and Sealed this

Twenty-second Day of November, 2005

JON W. DUDAS
*Director of the United States Patent and Trademark Office*